US006555966B2

(12) United States Patent
Pitigoi-Aron

(10) Patent No.: US 6,555,966 B2
(45) Date of Patent: Apr. 29, 2003

(54) CLOSED LOOP LIGHTING CONTROL SYSTEM

(75) Inventor: Radu Pitigoi-Aron, Danville, CA (US)

(73) Assignee: Watt Stopper, Inc., Santa Clara, CA (US)

( * ) Notice: Subject to any disclaimer, the term of this patent is extended or adjusted under 35 U.S.C. 154(b) by 0 days.

(21) Appl. No.: 09/865,962

(22) Filed: May 25, 2001

(65) Prior Publication Data

US 2002/0175639 A1 Nov. 28, 2002

(51) Int. Cl.[7] ..... H05B 29/04; H01J 40/14
(52) U.S. Cl. ..... 315/158; 250/214 AL
(58) Field of Search ..... 315/149, 150, 315/151, 152, 156, 158, 307, 153, 154, 155, 159; 250/214 AL

(56) References Cited

U.S. PATENT DOCUMENTS

| | | | | | |
|---|---|---|---|---|---|
| 3,912,866 | A | | 10/1975 | Fox | 179/1 E |
| 3,993,569 | A | | 11/1976 | Zinsmeyer et al. | 250/209 |
| 4,021,679 | A | | 5/1977 | Bolle et al. | 307/117 |
| 4,093,943 | A | | 6/1978 | Knight | 340/220 |
| 4,233,545 | A | * | 11/1980 | Webster | 250/214 AL |
| 4,330,706 | A | | 5/1982 | Lawenhaupt | 250/214 AL |
| 4,628,496 | A | | 12/1986 | Lee | 367/93 |
| 4,695,769 | A | * | 9/1987 | Schweickardt | 315/134 |
| 4,751,623 | A | | 6/1988 | Gaines et al. | 362/276 |
| 4,757,430 | A | | 7/1988 | Dubak et al. | 362/100 |
| 4,820,938 | A | | 4/1989 | Mix et al. | 307/117 |

(List continued on next page.)

OTHER PUBLICATIONS

Vishay, Vishay Telefunken, "Physics of Optoelectronic Devices Light–Emitting Diodes," Dec. 1999, pp. 1–7.

Vishay, Vishay Telefunken, "Measuring Technique General," Dec. 1999, pp. 1–9.

Asian Technology Information Program (ATIP), "Blue LED's: Breakthroughs and Implications," ATIP Report ATIP95.59, Aug. 27, 1995, See www.cs.arizona.edu/japan/atip.reports.95/atip95.59rhtml.

Energy User News, "The Coming Revolution in Lighting Practice," by Sam Berman, Oct. 2000, pp. 24–26.

IESNA Paper #59, "Characterizing Daylight Photosensor System Performance to Help Overcome Market Barriers," by Andrew Bierman et al.

Journal of the Illuminating Engineering Society, "Improving the Performance of Photo–Electrically Controlled Lighting Systems," by Francis Rubinstein et al., Winter 1989, pp. 70–94.

Specifier Reports, "Photosensors–Lightsensing devices that control output form electric lighting systems", National Light Product Information Program, vol. 6 No. 1, Mar. 1998, pp. 1 of 20.

"Si Photodiode –S7686", Hamamatsu, p. 1.

"Si Photodiodes –S6626, S6838", Hamamatsu, pp. 1–2.

"Si Photodiodes –S7160, S7160–01", Hamamatsu, pp. 1–2.

*Primary Examiner*—Don Wong
*Assistant Examiner*—Minh D A
(74) *Attorney, Agent, or Firm*—Haverstock Owens LLP

(57) ABSTRACT

The present invention provides a lighting control circuit having a light sensor that outputs a first signal in response to being exposed to radiation. The lighting control circuit has a detection circuit that is coupled to the light sensor and is configured to generate a second signal from the first signal. The lighting control circuit has a driver circuit that is coupled to the detection circuit and is configured to generate a third signal to control an illumination level of a light, wherein an amplitude of the third signal is varied in response to the second signal and a reference signal. The lighting control circuit also has a shifting reference circuit configured to shift a reference voltage of the driver circuit to compensate for a supplemental sunlight energy contributed to the ambient light in a room.

27 Claims, 3 Drawing Sheets

U.S. PATENT DOCUMENTS

| | | | | | |
|---|---|---|---|---|---|
| 5,015,994 | A | | 5/1991 | Hoberman et al. | 340/567 |
| 5,189,393 | A | | 2/1993 | Hu | 340/522 |
| 5,307,051 | A | | 4/1994 | Sedlmayr | 340/573 |
| 5,489,827 | A | * | 2/1996 | Xia | 315/154 |
| 5,495,402 | A | | 2/1996 | Houssian | 362/226 |
| 5,640,143 | A | | 6/1997 | Myron et al. | 340/541 |
| 5,699,243 | A | | 12/1997 | Eckel et al. | 364/140 |
| 5,701,058 | A | * | 12/1997 | Roth | 250/214 D |
| 5,713,655 | A | | 2/1998 | Blackman | 362/95 |
| D393,912 | S | | 4/1998 | Yuen | D26/26 |
| 5,763,872 | A | | 6/1998 | Ness | 250/214 AL |
| D409,317 | S | | 5/1999 | Yuen | D26/26 |
| 5,932,861 | A | * | 8/1999 | Iwaguchi et al. | 235/455 |
| 6,051,787 | A | | 4/2000 | Rintz | 174/66 |
| D425,222 | S | | 5/2000 | Yuen | D26/26 |
| D425,638 | S | | 5/2000 | Yuen | D26/26 |
| 6,084,231 | A | * | 7/2000 | Popat | 160/5 |
| 6,087,588 | A | | 7/2000 | Soules | 174/66 |
| D431,660 | S | | 10/2000 | Yuen | D26/26 |
| 6,132,057 | A | | 10/2000 | Williams | 362/100 |
| 6,151,529 | A | | 11/2000 | Batko | 700/28 |
| 6,172,301 | B1 | | 1/2001 | Goodsell | 174/66 |
| RE37,135 | E | | 4/2001 | Elwell | 315/154 |
| 6,337,541 | B1 | * | 1/2002 | Dickie et al. | 315/169.3 |
| 6,343,134 | B1 | | 1/2002 | Czerwinski | 381/342 |
| 6,390,647 | B1 | | 5/2002 | Shaefer | 362/276 |

* cited by examiner

CLOSED LOOP LIGHTING CONTROL SYSTEM

BACKGROUND OF THE INVENTION

The present invention relates generally to controlling the output of lights. More particularly, embodiments of the invention relate to a method and apparatus that use a shifting reference circuit for controlling light levels in an area or room.

Lighting control circuits are used with electronic dimming ballasts. These ballasts control the output of lights, such as fluorescent lights, that illuminate areas such as rooms, offices, patios, etc.

A conventional lighting control system measures the light in a separate environment outside the controlled area. Typically, a photocell is placed outdoors to detect sunlight. Such a system then uses information, e.g., illumination level, from the sunlight to adjust the light output in the controlled area. Such a system is called an open-loop system where the current ambient light level is not fed back into the system. Instead, an outside source alone, i.e., the sun, controls the system output. The sun, in effect, acts as a potentiometer controlling the lighting control system.

The design of these systems is based on the assumptions that the energy provided by the sun is proportional to visible light and that the light energy processed by the system directly represents visible light in the controlled area. Unfortunately, a system based on these assumptions results in inaccuracies. First, the sunlight's total influence or contribution is great relative to its visible portion. Also, when sun goes up, the indoor lights dim with or without window coverings such as blinds, curtains, etc. Thus, if a sensor does not take into account the light provided by the ambient light in the area it controls, the actions of the system would be unpredictable, hence less useful.

Thus, it is desirable to have an alternative lighting control circuit that can distinguish between different light sources and control the lighting in a particular area accordingly.

SUMMARY OF THE INVENTION

The present invention achieves the above needs with a new lighting control circuit. More particularly, the present invention provides a lighting control circuit having a light sensor that outputs a first signal in response to being exposed to radiation. The lighting control circuit has a detection circuit that is coupled to the light sensor and is configured to generate a second signal from the first signal. The lighting control circuit has a driver circuit that is coupled to the detection circuit and is configured to generate a third signal to control an illumination level of a light, wherein an amplitude of the third signal is varied in response to the second signal and a reference signal. The lighting control circuit also has a shifting reference circuit configured to shift a reference voltage of the driver circuit to compensate for a supplemental sunlight energy contributed to the ambient light in a room.

In another embodiment, the driver circuit receives the second signal and compares it to the reference signal. Also, the driver circuit is configured to match a voltage level of the second signal to a voltage level of the reference signal via a feedback loop, thereby either raising or lowering the illumination level of a light until the voltage of the second signal matches that of the reference signal.

In another embodiment, the shifting reference circuit generates a correction voltage proportional to the supplemental sunlight energy contributed to the ambient light in a room and adds the correction voltage to the reference voltage in the driver circuit, thereby compensating for the supplemental sunlight energy.

In another embodiment, the feedback loop comprises an opto-electric path and an electronic path, the opto-electric path traveling from a light source controlled by the lighting control circuit to the light sensor via the radiation from the light, the electronic path traveling from the light sensor to the light source via the lighting control circuit.

Embodiments of the present invention achieve their purposes in the context of known circuit technology and known techniques in the electronic arts. Further understanding, however, of the nature, objects, features, aspects and embodiments of the present invention is realized by reference to the latter portions of the specification, accompanying drawings, and appended claims. Other objects, features, aspects and embodiments of the present invention will become apparent upon consideration of the following detailed description, accompanying drawings, and appended claims.

DESCRIPTION OF THE SPECIFIC EMBODIMENTS

Figure 1:
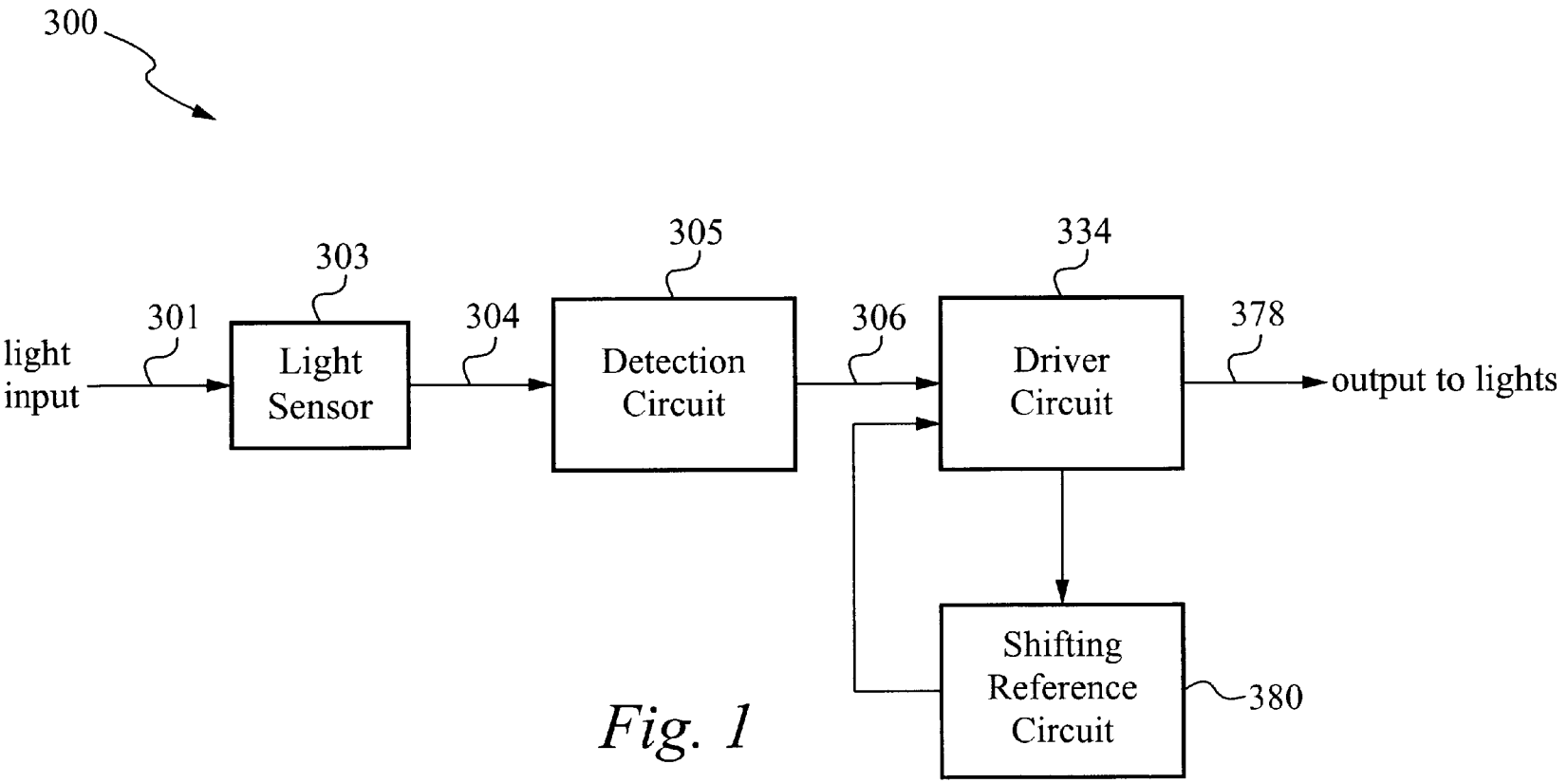
FIG. 1 shows a simplified high-level block diagram of a lighting control circuit including a light sensor, detection circuit, a driver circuit and a shifting reference circuit, according to an embodiment of the present invention.

FIG. 1 shows a simplified high-level block diagram of a lighting control circuit 300 that includes a light sensor 303, a detection circuit 305, driver circuit 334 and shifting reference circuit 380, according to an embodiment of the present invention. When light sensor 303 is exposed to light, it produces a small current or signal 304. The strength of signal 304 is proportional to the amount of light or illumination level. Embodiments of the present invention use an amplifier to amplify the light sensor's operating current.

Detection circuit 305 couples to driver circuit 334. Detection circuit 305 converts the light energy, detected by light sensor 303, into an electrical signal and amplifies the signal to a workable level (signal 306). Detection circuit 305 then sends the signal to driver circuit 334. Driver circuit 334 compares the voltage level of the signal from detection circuit 305 to a reference voltage and matches the two via a feedback loop. This reference voltage is adjustable and represents a set point or desired illumination level. If the illumination level is too high, detection circuit 334 lowers the voltage (signal 378) at an electronic ballast to dim a light source (not shown) until the light matches the desired illumination or light level. Conversely, if the illumination level is too low, detection circuit 334 raises the voltage (signal 378) at the electronic ballast to brighten the light source until the light matches the desired light level.

The lighting control circuit of FIG. 1 operates in a closed-loop environment. That is, the circuit takes the information related to the existing illumination level in a controlled area, such as in a particular room or office, and then compares the information to a preset value, or desired illumination level. The light sensor is placed in the same environment as the user. The circuit then varies the output of the controlled light sources to match the actual illumination level to the preset value. The main advantage of this approach is that the system adjusts the lighting outcome based on the amount of illumination that it receives from the controlled area. Being designed with a closed-loop, embodiments of the present invention can customize the light to a particular room and accurately control lighting in offices, skylit areas, cafeterias, warehouses and any other area with natural light access.

The closed-loop circuit of FIG. 1 includes two paths: an opto-electric path and an electronic path. The opto-electric path travels from the light source controlled by the ballast to the light sensor of detection circuit 305 via the light medium. Stated differently, the opto-electric path includes an electrical interpretation of light intensity or illumination. The electronic path travels from the light sensor to the light source via lighting control circuit 300.

Shifting reference circuit 380 shifts the reference voltage of driver circuit 334 to compensate for the supplemental sunlight contribution to the ambient light in a room. More specifically, as the driving voltage provided by driver circuit 334 changes due to sunlight, the sunlight is picked up by lighting control circuit 300 via light sensor 303 and transformed into a correction voltage. This correction voltage is correspondingly added to the reference voltage in the driver circuit to compensate for the supplemental energy contributed by the daylight. The closed loop function of the circuit is thus fully maintained.

Figure 2:
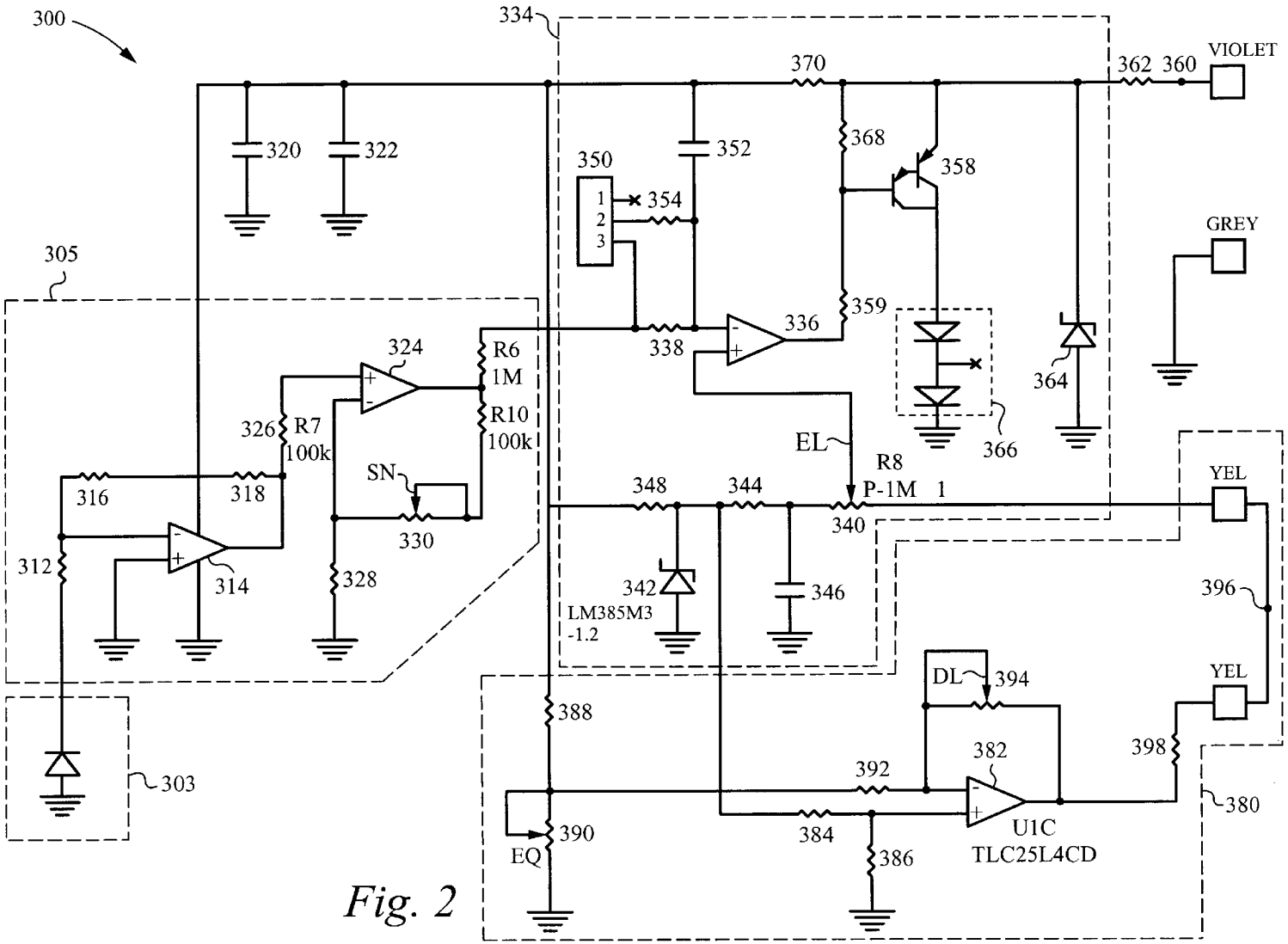
FIG. 2 shows one example of a simplified schematic diagram of a lighting control circuit according to the embodiment of FIG. 1.

FIG. 2 shows one example of a simplified schematic diagram of a lighting control circuit 300 according to the embodiment of FIG. 1. FIG. 2 shows a light sensor 303, a detection circuit 305, a driver circuit 334 and a shifting reference circuit 380. Light sensor 303 detects the light level in a room through a lens (not shown). In one embodiment, the lens is set such that the field of view for light sensor 303 is 60 degrees. The lens can be moved closer to or further from light sensor 303 to increase and decrease light sensor's 303 field of view.

Light sensor 303 picks up light and generates a small current, or electrical signal, proportional to the light. The output of light sensor 303 couples to a resistor 312 which is coupled to a inverting input of an op-amp 314. The non-inverting input of op-amp 314 couples to a ground potential. In this specific embodiment, op-amp 314 is a fixed gain amplifier. Embodiments of the present invention are not limited to this particular type of amplifier. The gain of op-amp 314 is set and controlled by resistors 316 and 318 in a manner well known to those in the art. Capacitors 320 and 322 couple between op-amp 314 and ground, providing stability to op-amp 314 in a manner well known to those in the art.

The amplified light signal is outputted from op-amp 314 to the non-inverting input of op-amp 324 via resistor 326. The inverting input of op-amp 324 couples to a ground potential via resistor 328. In this specific embodiment, op-amp 324 is an adjustable gain amplifier. Embodiments of the present invention are not limited to this particular type of amplifier. The gain of op-amp 324 is set and controlled by potentiometer 330 (also labeled SN in FIG. 2 and hereinafter referred to as pot SN 330) and resistor 332 in a manner well known to those in the art. Thus, the sensitivity of light sensor 303, i.e., gain of the detection circuit, can be adjusted by a user via pot SN 330. Pot SN 330 is described in more detail further below.

Detection circuit 305 increases the signal by 2 orders of magnitude (100×). The high-gain compensates for the low current generated by light sensor 303. The amplified signal is output from detection circuit 305 to a control circuit 334. Specifically, the amplified detected light level is outputted from op-amp 324 to the inverting input op-amp 336 via resistor 338.

Op-amp 336 outputs the difference between the reference voltage set at its non-inverting input and the signal output from op-amp 324. The non-inverting input of op-amp 336 couples to the wiper of a potentiometer 340 (also labeled EL in FIG. 2 and hereinafter referred to as pot EL 340). Pot EL 340 couples to a reference diode 342 via a resistor 344, and reference diode 342 couples to a ground potential. In this embodiment, reference diode 342 is a Zenor diode. The voltage at the non-inverting input of op-amp 336 is set between 0 volts and 0.6 volts, depending on the setting of pot EL 340. Resistor 348 couples to reference diode 342.

The response time of the control circuit to respond to changes in the detected light level is determined by the RC constant of op-amp 336. The RC constant can be adjusted according to the specific application. For example, in a manner well known to those in the art, the RC constant can be increased to delay the response time of the control circuit ensuring that it will not adjust the lighting if light sensor 303 is temporarily blocked by an object. Conversely, the RC constant can be decreased ensuring that the control circuit responds faster to light changes. Also, a faster response time is especially useful, for example, when a user makes adjustments to the light detector. With a faster response time, the user would only have to wait 15 seconds, for example, between adjustments rather than 60 seconds.

In the specific embodiment of FIG. 2, a switch 350 modifies the RC constant of op-amp 336. When switch 350 is open (either jumper removed or jumper over pins 1–2), the RC constant is set by resistor 338 and a capacitor 352. This produces a response time of about 60 seconds. When switch 350 is closed (jumper over pins 2–3), a resistor 354 couples in parallel with resistor 338 reducing the RC constant, thus making the circuit react faster to light changes. Accordingly, this produces a response time of about 15 seconds. Of course, those skilled in the art will recognize that additional resistors can be switched in and out to provide more than two response times to select from, or that changing the capacitance of the circuit can be done to change the time constant. Also, in combination with or in lieu of a switch resistor, jumper connectors and pins can be used to modify the RC constant.

The output of op-amp 336 couples to the base of a Darlington transistor 358 via a resistor 359. A Darlington transistor 358 amplifies the output of op-amp 336 to increase the number of ballasts that can be controlled by the control circuit. Of course, those skilled in the art will readily recognize that various other amplification devices such as a transistor or op-amp can be used in place of Darlington transistor 358.

In this specific embodiment, the emitter of Darlington transistor 358 couples to an output node 360, or electronic ballast node 360, via a resistor 362 and to a Zener diode 364. Reference diode 364 is a 12-volt Zener diode. It ensures that the voltage at node 360 does not increase above 12 volts and thus prevents damage to the circuit due to voltage spikes or if it is reverse connected. Node 360 couples to an electronic ballast which in turn couples to and controls lighting such as fluorescent lights. This specific embodiment is used with a dimming ballasts that use a 2–10 DC volt control signal.

When dimming, the driver circuit acts as a current sink which draws current from the current source incorporated into the electronic dimming ballast. By drawing a proper amount of current, a driving voltage results which in turn modifies the activity of the ballast.

The collector of Darlington transistor 358 couples to a pair of diodes 366. Diodes 366 ensure that potential at the collector of Darlington transistor 358 does not drop below 2 volts and thus ensures that the op-amps have a large enough power supply to operate correctly. The base of Darlington transistor 358 couples between a voltage divider, which includes resistor 359 and a resistor 368. A resistor 370 couples between resistor 386 and capacitor 352. It is to be understood that this specific implementation as depicted and described herein is for illustrative purposes only, and that alternative circuit implementations exist for the same functionality.

In operation, driver circuit 334 matches the light signal to a set point or desired illumination level by controlling a light source thus controlling the amount of light that detector circuit 305 picks up. Specifically, when the voltage level (derived from the ambient light) of the inverting input of op-amp 336 is greater than the voltage level (provided by the set point) of non-inverting input of op-amp 336, its output voltage lowers to compensate for the difference. This causes Darlington transistor 358 to draw current from and lower the driving voltage of the electronic ballast via node 360. As a result, the lights controlled by the electronic ballast dim. As a result, the illumination, being a part of the opto-electric path, is detected by the light sensor. Thus a lower voltage will appear at the inverting input of op-amp 336. This continues until the ambient light level matches the desired light level. When the ambient light level is lower than the desired light level, the complement of the process just described occurs, until ambient light level matches the desired light level.

Note that the following is considered in the embodiments of the present invention. First, the variation of nighttime illumination, e.g., due to aging of fluorescent lights, ambient moon light, or lighting from adjacent rooms and/or hallways, is small compared with the potential variation of incoming sunlight. For example, the illumination output from a fluorescent light might decrease only about 10% or less during its lifetime. Second, the main variable component of the ambient light is daylight. For example, the energy from sunlight could vary substantially throughout a given day because of clouds, window blinds, etc.

As it is apparent, some embodiments work under two essentially different conditions: during night and during the day. During the night they compensate for the small (aging) variations of illumination due to the fluorescent lights. During the day they compensate for the supplementary contribution of the daylight. In both situations an illumination level has to be set. To address this reality, some embodiments include two sets of adjustments, coping with the two before mentioned conditions.

Pot SN 330 (from the word "sensibility") controls the gain of detection circuit 305. The result of increasing the gain is in effect equivalent to the result of increasing the light contribution, and vice versa. In this specific embodiment, for example, the gain can range from 1 to 40 times. This is proportional to the illumination which can range from 1 to 40 foot-candles. A gain would thus cause the driver circuit to perceive a greater light level in the viewed or controlled area. Also, as a result of the gain, the driver circuit can more readily dim the lights because more light is perceived.

Some embodiments of the invention use this feature (pot SN 330) to customize the system to a particular controlled area. Specifically, these embodiments can account for the reflective characteristics of a controlled area. For example, a room with a bright color scheme or with white papers laying on a desktop would be more reflective. Accordingly, a user can adjust pot SN 330 to lower the gain while maintaining the desired illumination. Conversely, a user can increase the gain via pot SN 330 to account for a room that is less reflective, e.g., a room with a dark color scheme.

As described, op-amp 336 compares and matches the voltage from detection circuit 305 to a reference voltage (set point). Also, the set point is adjusted by pot EL 340 (from the word "electric light"). Thus, the resulting illumination level is controlled by a combination of the pot SN 330 and pot EL 340 settings. For maximum accuracy, pot SN 330 is kept at the maximum gain that yields the desired light level.

Incidentally, pot EL 340 also controls the brightness range in which a dimmable ballast can operate light sources connected to it. Pot EL 340 does this by adjusting the voltage at the non-inverting input of op-amp 336. Examples of such light sources include lighting such as fluorescent, HID, incandescent lights, etc.

In this specific embodiment, pot EL 340 sets the light level under "no daylight" conditions. That is, it sets the lights to an appropriate level determined by a user at night. When pot EL 340 is set to its maximum resistance, the voltage at the non-inverting input is at its lowest level and the controlled light can be adjusted anywhere from 20 to 100 percent output. Conversely, when pot EL 340 is set to its minimum resistance, the voltage at the non-inverting input is at its highest level and the intensity of the controlled light can be adjusted along a relatively small range.

To illustrate how pot EL 340 is set, the actual illumination level might be at 50 fc (100% of maximum illumination for example) due to a maximum driving voltage of 10 volts at the electronic ballast. Extra energy is consumed unnecessarily if only 40 fc (80% of maximum illumination) is necessary. Thus, the set point or desired illumination level should be lowered, e.g., 40 fc. To lower the actual illumination level down to 40 fc, the driving voltage at the electronic ballast should be lowered to approximately 8 volts. This would be done by adjusting pot EL 340 until the ambient light drops to 40 fc. A photometer can be used to measure the 40 fc.

Sunlight that enters an area having lights controlled by a lighting control circuit with an opto-electric feedback loop, such as lighting control circuit 300, presents challenges to the accuracy of a lighting control circuit. Shifting reference circuit 380 compensates for supplemental sunlight energy contributed to the ambient light in a room and improve the accuracy of the lighting control circuit.

Suppose for example, pot EL 340 were set at night such that it causes the actual illumination level to be 40 fc, the desired illumination level. The lighting control circuit becomes inaccurate in the morning if sunlight were to enter the controlled area. Due to the additional illumination from the sun, the driver circuit could dim the lights too much. Specifically, referring still to FIG. 2, driver 362 could drive electronic ballast node 360 from 6V down to 2V in the manner described above. The room would thus be too dark. Shifting reference circuit 380 would increase the reference voltage at driver circuit 334 by an amount proportional to the illumination of the sunlight contribution. This would in effect limit the degree to which the driver circuit dims the light. As a result, the lighting control circuit factors in the sunlight. Thus, while the voltage at node 360 is inversely related to the energy contribution of the sunlight, the shifting reference circuit limits the degree to which node 360 can be decreased.

It is to be understood that this specific implementation as depicted and described herein is for illustrative purposes only, and that alternative circuit implementations exist for the same functionality. For example, shifting reference circuit 380 can be used with various types of light sensors, i.e., photocells, photodiodes or optical sensors.

Referring to shifting reference circuit 380, the non-inverting input of comparator 382 couples to the anode of a reference diode 342 via a resistor 384 and couples to a ground potential via a resistor 386. A voltage divider including a resistor 388 and a pot 390 (also labeled EQ in FIG. 2 and hereinafter referred to as pot EQ 390) couples to the inverting input of comparator 382 via a resistor 392. In this specific embodiment, comparator 382 is adjustable and the desired compensation is set by a user. Specifically, the compensation of comparator 382 is set and controlled by a pot 394 (also labeled DL in FIG. 2 and hereinafter referred to as pot DL 394) in a manner well known to those in the art. The inverting input of comparator 382 couples to its output via pot DL 394. The output of comparator 382 couples to node 396 via a resistor 398. It is to be understood that this specific implementation as depicted and described herein is for illustrative purposes only, and that alternative circuit implementations exist for the same functionality.

Regarding setting of the pots of lighting control circuit 300, there are two adjustments, a daytime adjustment ("DAYLIGHT" value) and a nighttime adjustment ("NO DAYLIGHT" value). The two can differ. This specific embodiment allows for an adjustment of the illumination level to a 'DAYLIGHT' value, which again could be different from the corresponding 'NO DAYLIGHT' condition.

Between two adjusting points ('NO DAYLIGHT' and 'DAYLIGHT') the lighting control circuit performs a linear interpolation within the DAYLIGHT and the NO DAYLIGHT range, hence keeping the illumination level within predetermined range. The predetermined range could range, for example, between 2 and 70 foot-candles, or anywhere in between. Or, the lower limit could be a percentage of the upper limit.

Referring to op-amp 382 of FIG. 2, the voltage level at the inverting input is derived from output voltage (ballast node 360) of driver circuit 334. As the sunlight increases, the voltage level of the ballast node 360 decreases. The voltage level of the inverting input of op-amp 382 which follows ballast node 360 also decreases. When the voltage level at the inverting input becomes less than the reference voltage level applied to the non-inverting input, the output voltage of op-amp 336 increases to compensate for the voltage differential. This increases in reference voltage at the non-inverting input. In effect, the reference voltage increases as the sunlight increases.

The increase in the output of op-amp 382 in turn increases the reference voltage level at the non-inverting input of op-amp 336 which increases as much as ballast node 360 decreases. This increase in the output of op-amp 382 is the correction voltage described earlier. Thus, overdimming would not occur because the correction voltage substantially matches the voltage resulting from the sunlight contribution.

Shifting reference circuit 380 measures and compensates for the difference by raising the set point up back to 40 fc. Note that the voltage level at node 360 does not necessarily increase by 4 volts. More accurately it increases a certain amount such that the electrically produced light plus the sunlight substantially equal 40 fc.

If pot DL 394 is set to zero (unity gain), there will be substantially no effect on the driver circuit. Conversely, if DL is set to its maximum resistance (max gain), the voltage gain is reflected at ballast node 360 of the diver circuit, e.g., 300 mV to 1.2 V. Reference diode 342 ensures that the non-inverting input of op-amp 336 stays below 1.2 volts, approximately (more accurately 1.2V plus the sum of the voltage across resistor 344 and across pot EL 340.

In more detail, when node 336 is high, the inverting input of op-amp 382 being greater than the than the fixed voltage level at the non-inverting input of op-amp 382, its output voltage decreases to compensate for the difference. If DL is set to zero (unity gain), there will be substantially no effect on the driver circuit. If DL is set to its maximum resistance (max gain), the negative voltage gain is reflected at the set point of the driver circuit. The set point remains at its original setting, e.g., 200 mV, when it was set at night. Thus, no compensation occurs, or is even required under this condition. When the ambient light level is lower than the desired light level, the complement of the process just described occurs.

During the 'NO DAYLIGHT' adjustment, it is necessary to do a preparatory procedure for the 'DAYLIGHT' conditions. This sets the starting voltage at which the daylight influence is going to be counted. The final daylight illumination level will be established with pot DL 394. Again, pot DL determines how much the driving voltage variation would be amplified, hence establishing the corresponding daylight illumination level.

Again, when setting pot DL 394, it is again adjusted to compensate for the extra sunlight component such that the decrease in illumination is limited to substantially the amount of illumination contributed by the sun. So, after pots SN and EL are set the prior evening, pot DL 394 is set the next day when the sun is out. Using a photometer, pot DL 394 can be adjusted to bring the ambient light level down to the desired level.

The 'DAYLIGHT' illumination level is established when the controlled area is supplementary illuminated by the daylight. The incoming daylight illumination at the adjustment time should be a little lower then the difference between the residual illumination level when the fluorescent lights are fully dimmed and the desired illumination level under the 'DAYLIGHT' conditions. By acting upon pot DL 394, the desired illumination level shall be set.

Pot DL 394 sets the light level under "maximum adjustable daylight" conditions. By 'MAX Adjustable Daylight' is to be understood the greatest amount of incoming daylight that can be compensated by dimming the electric light. The fc value of this parameter is close to the difference between the 'NO DAYLIGHT' set value and the residual Electric Light level that is left under fully dimmed electric lights. This parameter is a real life expression of the fact that the Electric Lights are not completely dimmed even at full dimming drive of the controller on one hand and the incoming daylight could be over the adjusted 'NO DAYLIGHT' value, on the other hand.

When it is night again, there is still a gain from the shifting reference circuit. This gain would then cause the light level to be too bright. To correct this, pot EQ 390 (described in detail below) is used to compensate.

Pot EQ 390 (from the word "equalizer") sets the starting point of a "daylight correction voltage." Once the sunlight contribution increased passes a certain threshold, the daylight correction voltage kicks in. This correction voltage determines the gain that the shifting reference circuit contributes.

Under the initial 'NO DAYLIGHT' conditions, DL was positioned for 'no gain'. At the same time, the EQ trim pot was on zero, hence whichever the driving voltage was, it won't influence the 'NO DAYLIGHT' adjustment.

Pot EQ 390 matches two voltages inside of the closed loop. The voltages are those at the inputs of shifting reference circuit 380, for the 'NO DAYLIGHT' condition. In order to make the EQ action visible, the operator has to set DL for a position at which the controlled illumination level has increased by a visible amount. Then the EQ pot should be such adjusted so to decrease back the illumination level to where it was or just a little higher. This will ensure that the starting point of the daylight correction is from the nighttime illumination level up.

With the proper adjustments, the system keeps the illumination level within plus or minus 3 fc from the set level for as long as the daylight level does not exceed the top margin. After that, the fluorescent lights would be fully dimmed and the area is going to be illuminated as much as the bright daylight would allow.

Figure 3:
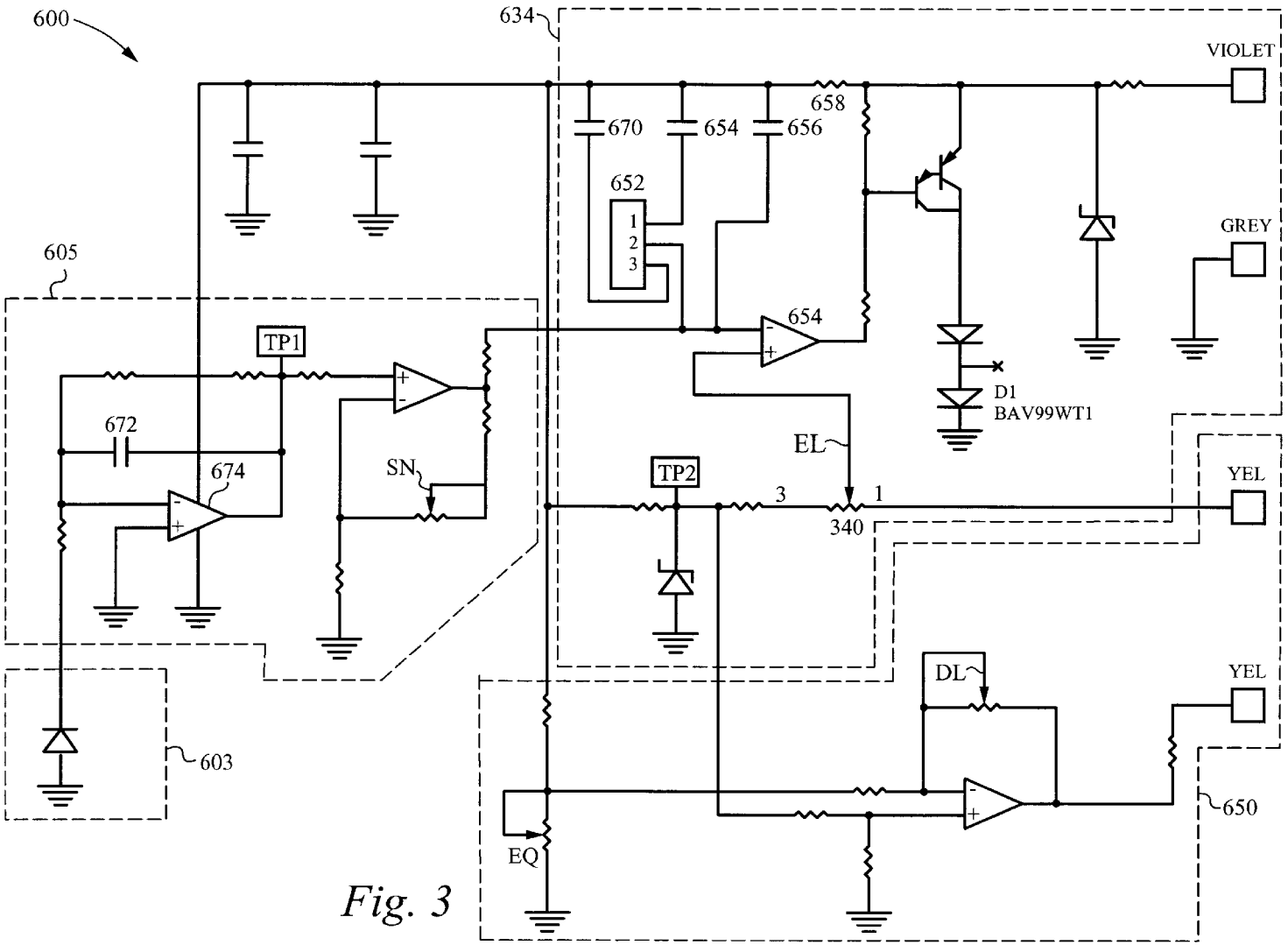
FIG. 3 shows another example of a simplified schematic diagram of a lighting control circuit, according another embodiment of FIG. 1.

FIG. 3 shows another example of a simplified schematic diagram of a lighting control circuit 600, according to the embodiment of FIG. 1. FIG. 3 shows a light sensor 603, a detection circuit 605, a driver circuit 634 and a shifting reference circuit 650, according to another embodiment of the present invention. The primary difference between the embodiment FIG. 3 and that of FIG. 2 is the inclusion of a switch 652 which modifies the RC constant of op-amp 654. When switch 652 is closed such that capacitor 654 couples in parallel to capacitor 656 (jumper over pins 1–2), the RC constant is set by capacitors 654 and 656 and resistor 658. This produces a response time of about 60 seconds. When switch 652 is closed such that capacitor 670 couples in parallel to capacitor 656 (jumper over pins 2–3), the RC constant increases, thus making the circuit react faster to light changes. Accordingly, this produces a response time of about 15 seconds. When switch 652 is open (jumper removed), the RC constant is set by resistor R1 and a capacitor 656. Accordingly, this produces a response time of about 1 second. Detection circuit 605 includes a capacitor 672 that is coupled between the inverting input and output of op-amp 674. It is to be understood that this specific implementation as depicted and described herein is for illustrative purposes only, and that alternative circuit implementations exist for the same functionality. For example, shifting reference circuit 650 can be used with various detection systems, i.e., photocells, photodiodes or optical sensors.

Embodiments of the present invention can have a number of applications. In one example, as described above, the lighting control circuit can be used for illumination management where the visible spectrum is the main target.

CONCLUSION

In conclusion, it can be seen that embodiments of the present invention provide numerous advantages and elegant techniques for controlling lighting. Principally, it distinguishes between different light sources such as sunlight and electronically produced light. It can also control the lighting in a particular area accordingly. It also eliminates problems associated with open-loop systems. It is also eliminates the costs associated with expensive optical filters.

Specific embodiments of the present invention are presented above for purposes of illustration and description. The full description will enable others skilled in the art to best utilize and practice the invention in various embodiments and with various modifications suited to particular uses. After reading and understanding the present disclosure, many modifications, variations, alternatives, and equivalents will be apparent to a person skilled in the art and are intended to be within the scope of this invention. Therefore, it is not intended to be exhaustive or to limit the invention to the specific embodiments described, but is intended to be accorded the widest scope consistent with the principles and novel features disclosed herein, and as defined by the following claims.

What is claimed is:

1. A lighting control circuit comprising:

a light sensor that outputs a first signal in response to being exposed to radiation;

a detection circuit coupled to the light sensor, the detection circuit configured to generate a second signal from the first signal;

a driver circuit coupled to the detection circuit, the driver circuit configured to generate a third signal to control an illumination level of a light, wherein an amplitude of the third signal is varied in response to the second signal and a reference voltage; and a shifting reference circuit configured to shift the reference voltage of the driver circuit to compensate for a supplemental sunlight energy contributed to the ambient light in a room;

wherein the driver circuit receives the second signal and compares it to the reference voltage, and wherein the driver circuit is configured to match a voltage level of the second signal to the reference voltage via a feedback loop, thereby either raising or lowering the illumination level of a light until the voltage of the second signal matches that of the reference voltage.

2. The circuit of claim 1 wherein the shifting reference circuit generates a correction voltage proportional to the supplemental sunlight energy contributed to the ambient light in a room, and wherein the shifting reference circuit adds the correction voltage to the reference voltage in the driver circuit, thereby compensating for the supplemental sunlight energy.

3. The circuit of claim 1 wherein the feedback loop comprises an opto-electric path and an electronic path, the opto-electric path traveling from a light source controlled by the lighting control circuit to the light sensor via the radiation from the light, the electronic path traveling from the light sensor to the light source via the lighting control circuit.

4. The circuit of claim 1 wherein the shifting reference circuit increases the reference voltage by an amount proportional to the supplemental sunlight energy contributed to the ambient light in the room.

5. The circuit of claim 1 wherein the driver circuit comprises a comparator configured to produce a driving voltage that is inversely related to the energy contribution of sunlight, the shifting reference circuit configured to transform a drop in the driving voltage caused by the energy contribution of sunlight into a correction voltage, the correction voltage being added to the reference voltage in the driver circuit to compensate for the supplemental sunlight energy contributed to the ambient light in the room.

6. The circuit of claim 1 wherein the shifting reference circuit comprises:

an op-amp for producing a correction voltage that is directly related to a portion of the electrical signal that is contributed by sunlight, the correction voltage being added to the reference voltage to compensate for the portion of the electrical signal that is contributed by the sunlight;

a first potentiometer coupled to the op-amp and configured for adjusting the gain of the op-amp; and generating a third signal to control an illumination level of a light, wherein an amplitude of the third signal is varied in response to the second signal; and shifting a reference voltage to compensate for a supplemental sunlight energy contributed to the ambient light in a room, the shifting step including, generating a correction voltage proportional to the supplemental sunlight energy, and adding the correction voltage to the reference voltage.

7. The circuit of claim 8 wherein a non-inverting input of the op-amp couples to the anode of a reference diode via a first resistor and couples to a ground potential via a second resistor, and wherein an inverting input of the op-amp couples to a voltage divider via a third resistor, and wherein the inverting input of the op-amp couples to an output of the op-amp via the first potentiometer, and wherein the output of the op-amp couples to the driver circuit.

8. The circuit of claim 1 wherein the detection circuit includes a first amplifier circuit coupled between the light sensor and a second amplifier circuit, the first amplifier circuit is configured to amplify the first signal, and the second amplifier circuit is configured to amplify output of the first amplifier circuit.

9. The circuit of claim 8 where in the first and second amplifier circuits amplify the first signal by at least two orders of magnitude.

10. The circuit of claim 8 wherein the first amplifier circuit is a fixed-gain-amplifier circuit and the second amplifier circuit has an amplification controlled by a user-controllable potentiometer.

11. The circuit of claim 1 wherein the driver circuit includes an op-amp configured to output the difference between the reference voltage and the voltage of the second signal.

12. The circuit of claim 11 wherein the driver circuit includes a Darlington transistor having a base coupled to an output of the op-amp, a collector coupled to ground through a pair of diodes, and an emitter coupled to an output node of the driver circuit.

13. The circuit of claim 12 wherein an output of the op-amp is coupled to the output node of the driver circuit through at least one resistor.

14. The circuit of claim 11 wherein the driver circuit includes a user-controllable potentiometer configured to shift the reference voltage.

15. The circuit of claim 1 wherein the driver circuit is configured to drive at least one ballast of the light.

16. The circuit of claim 1 wherein the driver circuit includes a user-controllable-delay circuit for controlling a time delay for changing the illumination level of the light.

17. The circuit of claim 16 wherein the user-controllable-delay-circuit includes a plurality of user-selectable RC circuits.

18. The circuit of claim 1 wherein the shifting reference circuit includes a comparator circuit configured to generate a correction voltage proportional to the supplemental sunlight energy contributed to the ambient light in a room, and the correction voltage is added to the reference voltage in the driver circuit via a user-controllable potentiometer of the driver circuit, thereby compensating for the supplemental sunlight energy.

19. The circuit of claim 18 wherein the output of the comparator is controllable by another user-controllable potentiometer.

20. A lighting control circuit comprising:

a light sensor that outputs a first signal in response to being exposed to radiation;

a detection circuit coupled to the light sensor, the detection circuit configured to generate a second signal from the first signal;

a driver circuit coupled to the detection circuit, the driver circuit configured to generate a third signal to control an illumination level of a light, wherein an amplitude of the third signal is varied in response to the second signal, wherein the driver circuit receives the second signal and compares it to the reference signal, and wherein the driver circuit is configured to match a voltage level of the second signal to a voltage level of the reference signal via a feedback loop, thereby either raising or lowering the illumination level of a light until the voltage of the second signal matches that of the reference signal; and a shifting reference circuit configured to shift a reference voltage of the driver circuit to compensate for a supplemental sunlight energy contributed to the ambient light in a room, wherein the shifting reference circuit generates a correction voltage proportional to the supplemental sunlight energy contributed to the ambient light in a room, and wherein the shifting reference circuit adds the correction voltage to the reference voltage in the driver circuit, thereby compensating for the supplemental sunlight energy.

21. The circuit of claim 20 wherein the detection circuit includes a first amplifier circuit coupled between the light sensor and a second amplifier circuit, the first amplifier circuit is configured to amplify the first signal, and the second amplifier circuit is configured to amplify output of the first amplifier circuit.

22. The circuit of claim 21 where in the first and second amplifier circuits amplify the first signal by at least two orders of magnitude.

23. The circuit of claim 20 wherein the shifting reference circuit includes a comparator circuit configured to generate a correction voltage proportional to the supplemental sunlight energy contributed to the ambient light in a room, and the correction voltage is added to the reference voltage in the driver circuit via a user-controllable potentiometer of the driver circuit, thereby compensating for the supplemental sunlight energy.

24. The circuit of claim 23 wherein the output of the comparator is controllable by another user-controllable potentiometer.

25. A method for controlling the brightness level of a light, the method comprising:

exposing a light sensor to radiation;

outputting from the light sensor a first signal in response to the radiation exposure;

generating a second signal from the first signal;

generating a third signal to control an illumination level of a light, wherein an amplitude of the third signal is varied in response to the second signal; and shifting a reference voltage to compensate for a supplemental sunlight energy contributed to the ambient light in a room.

26. The method of claim 25 wherein generating the third signal comprises comparing a voltage level of the second signal to that of the reference voltage and matching the voltage level of the second signal to that of the reference voltage.

27. The method of claim 26 wherein the step of matching further comprises adjusting the ambient light level until the second signal matches the reference voltage.

* * * * *

UNITED STATES PATENT AND TRADEMARK OFFICE

CERTIFICATE OF CORRECTION

PATENT NO. : 6,555,966 B2
DATED : April 29, 2003
INVENTOR(S) : Radu Pitigoi-Aron It is certified that error appears in the above-identified patent and that said Letters Patent is hereby corrected as shown below:

Column 11,
Delete lines 6-15, and insert -- a second potentiometer coupled to the inverting input of the op-amp and configured for creating a threshold at which the correction voltage is applied to the electrical signal. --
Line 15, replace "claim 8" with -- claim 6 --.

Column 12,
Line 11, replace "the reference signal" with -- a reference voltage --.
Line 13, delete "a voltage level of".
Line 14, replace "signal" with -- voltage --.
Line 18, replace "shift a reference" with -- shift the reference --.
Line 57, delete "room." and insert -- room, the shifting step including, generating a correction voltage proportional to the supplemental sunlight energy, and adding the correction voltage to the reference voltage. --

Signed and Sealed this

Sixteenth Day of September, 2003

JAMES E. ROGAN
*Director of the United States Patent and Trademark Office*